United States Patent [19]

Morse

[11] 4,372,536

[45] Feb. 8, 1983

[54] TRAFFIC BARRICADE

[75] Inventor: Randall L. Morse, Waverly, Nebr.

[73] Assignee: Trafcon, Inc., Lincoln, Nebr.

[21] Appl. No.: 241,251

[22] Filed: Mar. 6, 1981

[51] Int. Cl.[3] ..... E01F 13/00

[52] U.S. Cl. ..... 256/64; 404/6

[58] Field of Search ..... 256/1, 13.1, 64, 31, 256/35; 116/63; 404/6; 182/224, 225, 226, 227; 40/606, 607, 610, 612

[56] References Cited

U.S. PATENT DOCUMENTS

| | | | |
|---|---|---|---|
| 376,876 | 1/1888 | Goodrich | 182/227 X |
| 3,802,667 | 4/1974 | Kanan | 256/64 |
| 3,917,232 | 11/1975 | Lindner | 404/6 X |
| 4,183,695 | 1/1980 | Wilcox | 256/1 X |

FOREIGN PATENT DOCUMENTS

| | | | |
|---|---|---|---|
| 942,392 | 9/1948 | France | 40/612 |

*Primary Examiner*—Richard J. Scanlan, Jr.
*Attorney, Agent, or Firm*—Zarley, McKee, Thomte, Voorhees & Sease

[57] ABSTRACT

A traffic barricade of the portable type comprising first and second vertically disposed frame members having a pair of vertically disposed and horizontally spaced barricade panels secured thereto and extending therebetween. First and second legs are pivotally secured at their upper ends to the first frame member intermediate the length thereof and third and fourth legs are pivotally secured at their upper ends to the second frame member intermediate the length thereof. A channel-shaped member is positioned between the upper ends of the legs and the respective frame members which limits the pivotal movement of the legs with respect to the frame members and causes the frame members to be vertically disposed when the barricade is in the operative position. The barricade may be folded from the operative position to a substantially flat position.

2 Claims, 5 Drawing Figures

TRAFFIC BARRICADE

BACKGROUND OF THE INVENTION

This invention relates to a traffic barricade and more particularly to a portable traffic barricade wherein the barricade panels are positioned in a vertically disposed condition when the barricade is in the operative position.

Traffic barricades of the portable type have long been used to aid in barricading or directing traffic around obstacles or the like. One common type of traffic barricade is the A-frame design wherein barricade panels are positioned on either side of the device. In such devices, the barricade panels do not dwell in a vertical plane but dwell in an inclined plane. Many states are now requiring that the barricade panels be positioned in a vertically disposed condition when the barricade is in the operative position so as to maximize the visibility of the barricade panels.

One type of barricade has been devised wherein vertically disposed frame members support the barricade panels and which have a horizontally disposed frame member at the lower end. In other words, the frames at the ends of the barricade define an inverted T-shape. A problem associated with the inverted T-shaped barricade is that they pose a dangerous threat to traffic if the barricade should be blown over or the like due to the fact that one end of the supporting legs will extend upwardly.

Other types of barricades have been devised but they are not convenient to use and do not adequately support themselves in an operative position nor can they be conveniently stored in a substantially flat position.

Therefore, it is a principal object of the invention to provide an improved traffic barricade.

A still further object of the invention is to provide a portable barricade wherein the barricade panels are positioned in a vertically disposed condition when the barricade is in the operative position.

A further object of the invention is to provide a traffic barricade which assumes a substantially flat position when in the inoperative position or when it has been inadvertently moved from the operative position.

A further object of the invention is to provide a traffic barricade which includes means for stabilizing the same in the operative position.

These and other objects will be apparent to those skilled in the art.

SUMMARY OF THE INVENTION

Figure 1:
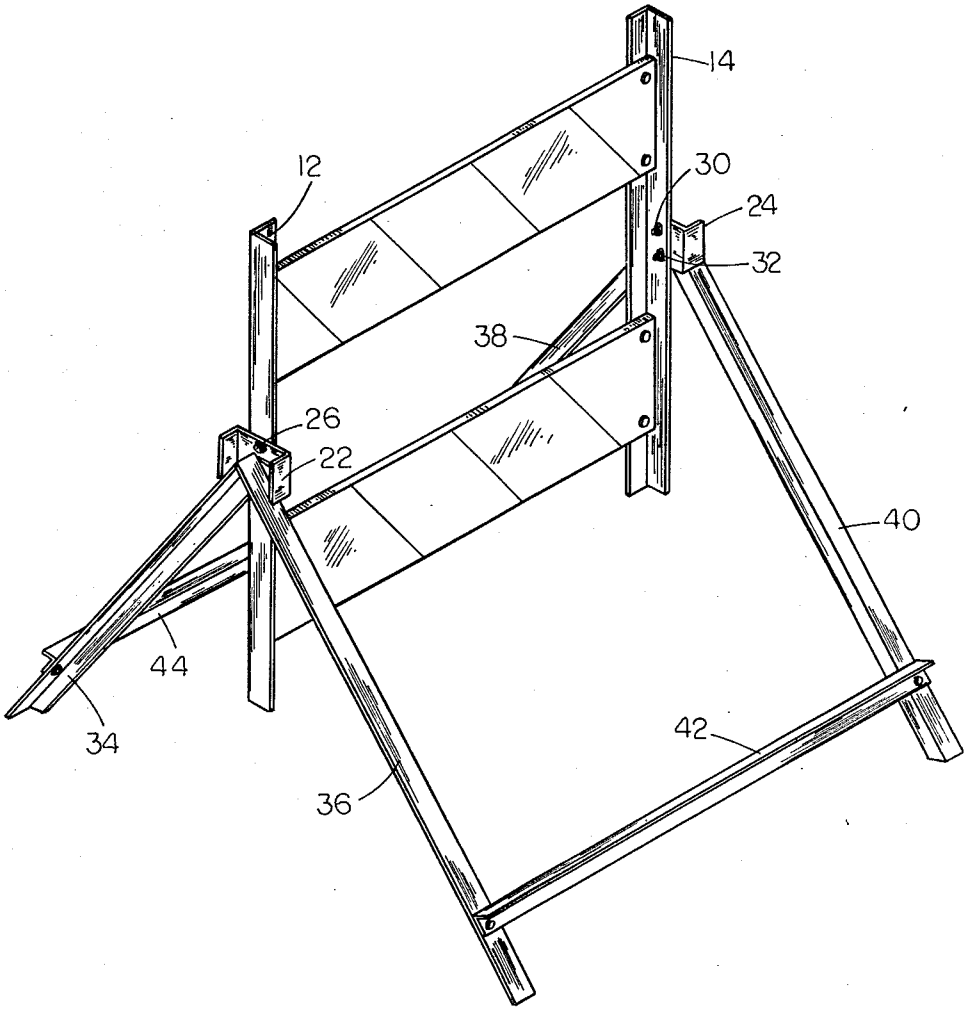
FIG. 1 is a perspective view of the barricade of this invention in the operative position.

A portable barricade is disclosed wherein a pair of legs are pivotally secured at their upper ends to vertically disposed and horizontally spaced frame members which have at least a pair of barricade panels secured thereto and extending therebetween. A channel-shaped member is positioned between the frame members and the legs to limit the outward pivotal movement of the legs with respect to the frame members and to insure that the frame members will be vertically disposed when the barricade is in the operative position. The upper ends of the frame members extend above the panel members to permit warning lights or the like to be mounted thereon.

DESCRIPTION OF THE PREFERRED EMBODIMENT

The numeral 10 refers generally to the barricade of this invention. Barricade 10 includes frame members 12 and 14 which are normally vertically disposed and horizontally spaced with respect to each other. In the preferred embodiment, frame members 12 and 14 are of the angular configuration seen in the drawings. Preferably, a pair of barricade panels 16 and 18 are secured to and extend between the frame members 12 and 14 in a vertically spaced relationship. It is conceivable that a single panel could be employed but most barricade specifications call for at least a pair of the panels. The panels 16 and 18 are provided with customary reflective surfaces on the opposite sides thereof. The panels 16 and 18 are secured to the frame members 12 and 14 by means of bolts 20 as illustrated in the drawings.

Figure 2:
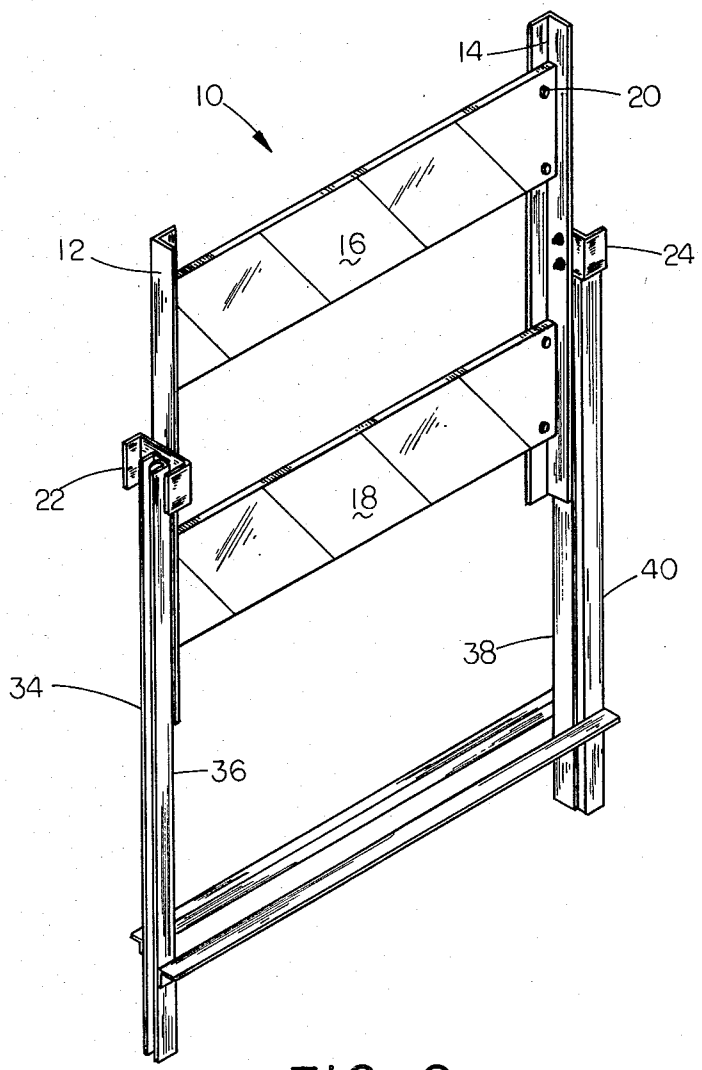
FIG. 2 is a perspective view of the barricade of this invention in the folded or inoperative position.
Figure 3:
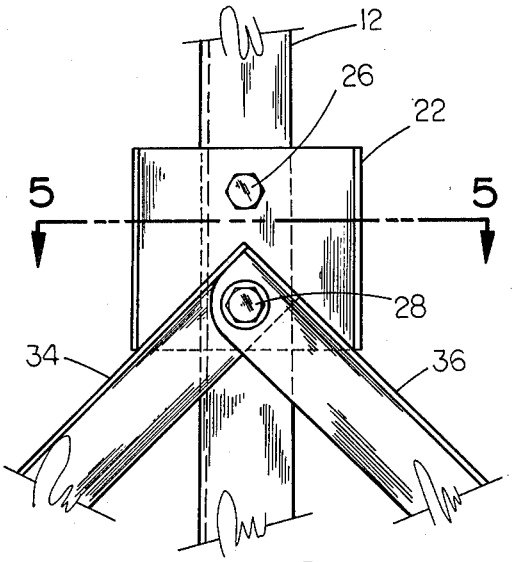
FIG. 3 is a partial end view illustrating the manner of connecting the legs to the barricade panel frame members.
Figure 4:
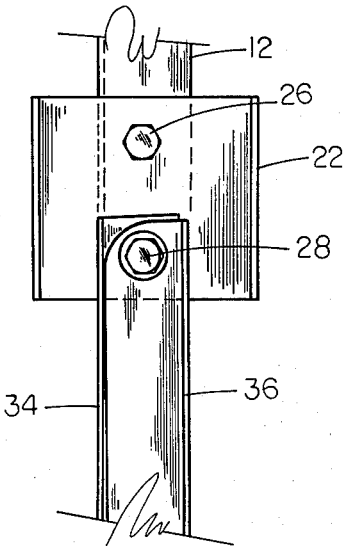
FIG. 4 is a view similar to FIG. 3 but which illustrates the legs in the folded position.
Figure 5:
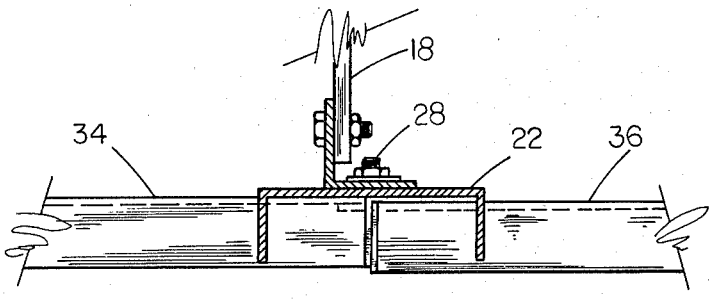
FIG. 5 is a sectional view seen on lines 5—5 of FIG 3.

Channel-shaped supports 22 and 24 are secured to frame members 12 and 14 intermediate the length thereof by means of bolts 26, 28 and 30, 32 respectively. Legs 34 and 36 are pivotally secured at their upper ends to the support 22 and the frame member 12 by means of bolt 28 as best illustrated in FIGS. 3 and 4. Likewise, legs 38 and 40 are pivotally secured to the support 24 and frame member 14 by means of bolt 32. Brace 42 is secured to and extends between the legs 36 and 40 while brace 44 is secured to and extends between the legs 34 and 38. The legs 34 and 36 are pivotally movable from the storage position of FIG. 2 wherein the legs 34 and 36 are substantially parallel to the frame member 12 to the operative position illustrated in FIG. 1 wherein the legs 34 and 36 extend downwardly and outwardly from frame member 12 for ground engagement. Similarly, the legs 38 and 40 are also selectively pivotally movable. In the storage position of FIG. 2, the barricade 10 will occupy very little space so that it may be conveniently stored. When it is desired to place the barricade in position, the legs are simply pivotally moved upwardly with respect to the frame members 12 and 14 from the position of FIG. 2 to the position of FIG. 1. The legs may be pivotally moved outwardly until the legs engage the lower ends of the supports 22 and 24 which limits the outward pivotal movement of the legs. The supports 22 and 24 not only limit the pivotal movement of the legs but also maintains the frame members 12 and 14 in the vertically disposed position which is extremely important if the barricade is going to comply to highway specifications. It should also be noted that the upper ends of the legs engage each other as illustrated in FIG. 3 when the legs are in the operative position which further stabilizes the assembly.

As illustrated in the drawings, the upper ends of the frame members 12 and 14 are positioned above the uppermost barricade panel so that warning lights or the like may be mounted thereon.

Thus it can be seen that a novel barricade has been provided which insures that the reflective barricade panels will be properly maintained in the vertically disposed position when the barricade is in the operative position. The barricade will be extremely stable and may be further stabilized by placing sandbags or the like on the braces 42 and 44. Thus it can be seen that the barricade of this invention accomplishes at least all of its stated objectives.

I claim:

1. A portable barricade, comprising, first and second frame members normally being vertically disposed and horizontally spaced with respect to each other and having upper and lower ends, at least one barricade panel secured to and extending between said first and second frame members and normally dwelling in a vertical plane, first and second legs, having upper and lower ends, pivotally secured at their upper ends to said first frame member, third and fourth legs, having upper and lower ends, pivotally secured at their upper ends to said second frame member, said first and second legs being selectively movable from a storage position wherein said first and second legs are substantially parallel to said first frame member to an operative position wherein said first and second legs extend downwardly and outwardly from said first frame member, said third and fourth legs being selectively movable from a storage position wherein said third and fourth legs are substantially parallel to said second frame member to an operative position wherein said third and fourth legs extend downwardly and outwardly from said second frame member, and means operatively interconnecting said legs and said frame members which maintains said frame members and said panel in their vertically disposed position when said legs are in their said operative position, said means interconnecting said legs and frame members comprising channel-shaped members positioned between said legs and frame members, each of said channel-shaped members comprising a vertically disposed base secured to the respective frame member and a pair of side walls extending outwardly from said base, said legs being pivotally secured to said channel-shaped members and frame members below the connection of the associated channel-shaped member and frame members.

2. The barricade of claim 1 wherein each of said side walls of said channel-shaped members have upper and lower ends, said legs engaging the lower ends of said side walls to limit the pivotal movement of said legs and to maintain said frame members in their vertically disposed position when the legs are in their operative position.

* * * * *